US005185946A

United States Patent [19]

Farrell

[11] Patent Number: 5,185,946

[45] Date of Patent: Feb. 16, 1993

[54] PLOW ASSEMBLY WITH FLEXIBLE MOLDBOARD

[76] Inventor: Eugene A. Farrell, P.O. Box 477, Fishers Landing, N.Y. 13641

[21] Appl. No.: 818,276

[22] Filed: Jan. 8, 1992

Related U.S. Application Data

[62] Division of Ser. No. 512,932, Apr. 23, 1990, Pat. No. 5,079,866.

[51] Int. Cl.[5] ..... E01H 5/06

[52] U.S. Cl. ..... 37/231; 37/270; 172/719; 172/751; 172/772

[58] Field of Search ..... 37/232, 233, 266, 270, 37/271; 172/719, 751, 772, 772.5

[56] References Cited

U.S. PATENT DOCUMENTS

| | | | |
|---|---|---|---|
| 601,561 | 3/1898 | Gleason | 172/751 |
| 919,303 | 4/1909 | Atkins | 172/772 |
| 2,189,745 | 2/1940 | Johnson | 172/772 |
| 3,160,965 | 12/1964 | Walker et al. | 37/270 X |
| 3,463,523 | 8/1969 | Vasas | 172/719 |
| 3,477,520 | 11/1969 | Gray | 172/751 |
| 4,058,173 | 11/1977 | Carson | 172/751 X |
| 4,259,794 | 4/1981 | Rath | 37/270 X |

FOREIGN PATENT DOCUMENTS

| | | | |
|---|---|---|---|
| 2437723 | 3/1975 | Fed. Rep. of Germany | 37/232 |
| 27153 | 1/1955 | Finland | 37/270 |
| 129656 | 10/1950 | Sweden | 37/271 |
| 141133 | 7/1953 | Sweden | 37/270 |

*Primary Examiner*—Randolph A. Reese
*Assistant Examiner*—Arlen L. Olsen
*Attorney, Agent, or Firm*—Burns, Doane, Swecker & Mathis

[57] ABSTRACT

A plow assembly useful for moving material from surfaces such as roadways in various selectable discharge directions includes a moldboard assembly and pivotable frame. The moldboard assembly is capable of being oriented in a right side discharge or a left side discharge in response to pivoting movement of the pivotable frame. A tripping mechanism is included to prevent damage of the plow assembly from obstacles located on the plowing surface. A cutting edge of the plow assembly is secured to the moldboard assembly by a wedge mechanism thus allowing quick cutting edge replacement.

6 Claims, 10 Drawing Sheets

PLOW ASSEMBLY WITH FLEXIBLE MOLDBOARD

This application is a divisional of application Ser. No. 07/512,932, filed Apr. 23, 1990 now U.S. Pat. No. 5,079,866.

FIELD OF THE INVENTION

The present invention relates to devices useful for removing material such as snow from surfaces such as roads and parking lots. More particularly, the present invention relates to plow devices that are capable of moving material from surfaces in various selectable discharge directions.

BACKGROUND AND SUMMARY OF THE INVENTION

Conventional plowing devices typically incorporate a metal moldboard that has been pre-formed into a desired shape according to the intended use of the plowing device. In some instances, it is desirable to use a metal moldboard that is formed into a side discharge configuration as shown in U.S. Pat. No. 4,045,892 granted to Farrell while in others, it is desirable to use a moldboard that is pre-formed into a dual side discharge configuration as shown in U.S. Pat. No. 4,459,769 granted to Willis. Sr. Since the metal moldboards are preformed, however, the metal moldboards must be repeatedly interchanged according to the conditions of the surfaces needing plowing. For example, a street may require the plowing of snow to the right side of the street while the moldboard mounted on the vehicle is configured to move the snow only to the left. The time required to switch the left discharge moldboard with a right discharge moldboard is highly undesirable since the vehicle is removed from service during such changeover.

The metal moldboards also present other problems of economics. For example, forming the metal moldboards into a desired configuration requires a laborious bending process during fabrication which adds significantly to the moldboard cost. Additionally, since the moldboards are composed of metal, the weight of the plowing device is quite heavy thus significantly detracting from the efficient fuel consumption of the plowing vehicle.

It has been known to avoid some of the problems associated with the use of pre-formed metal moldboards by instead using a plastic moldboard as shown in U.S. Pat. No. 4,837,951 issued to Verseef. In the device disclosed in the Verseef patent, undesirable downtime of the vehicle due to changing of a moldboard is avoided since the same moldboard may be selectively oriented in either a right, left or intermediate discharge position. Specifically, the Verseef patent discloses a plastic moldboard that may be selectively formed into a desired configuration by the vehicle operator according to the actuation of a plurality of hydraulic cylinders. The formation of the moldboard into the desired configuration is completely separate from any other operation of the plow.

While the device disclosed in the Verseef reference may offer improvements in operating costs over the operating costs associated with pre-formed metal moldboards, the Verseef device suggests a complexity that is likely to increase upfront purchase costs. The Verseef device also utilizes a number of operating mechanisms that are likely to degrade plow reliability as well as contribute to excessive maintenance downtime. For example, to arrange the plastic moldboard into a desired orientation, the Verseef device requires the simultaneous actuation of two dual acting hydraulic cylinders that must be supported by an appropriate hydraulic valving apparatus. Should such a hydraulic system fail, the usefulness of selectably orienting the plastic moldboard would be disabled.

Further, the Verseef device retains the plastic moldboard within the plow framework in a manner that may decrease the operating life of the plastic moldboard. In particular, the plastic moldboard in the Verseef device is attached to the plow framework in part by two baseplates that fail to allow the plastic moldboard appropriate freedom of movement during orientation of the moldboard. Since the moldboard is restricted from movement, undesirable stresses will be repeatedly induced in the plastic moldboard during orientation thus decreasing the useful life of the moldboard.

Yet still further, the Verseef device utilizes a scraper blade that apparently is attached to the lower portion of the plow by commonly known fasteners. As is commonly known within the art, extended use of a scraper blade causes the fasteners to become corroded thus hampering efforts to replace the scraper blade when necessary. The fasteners may become so corroded as to fail during attempted removal. Such detractions during replacement efforts of the scraper blade, increase the amount of valuable time a vehicle may be unavailable for plowing use.

In view of the above, it is an object of the present invention to provide an improved plowing device which is readily capable of selective discharge of the plowed material.

A further object of the present invention is to provide a plowing device of high reliability and low complexity.

It is a further object of the present invention to provide a plowing device requiring low maintenance.

It is a further object of the present invention to provide a plowing device capable of selectively changing the discharge direction of a moldboard in response to pivoting of the plowing device.

Another object of the present invention is to provide a plowing device having a scraper blade that is easily replaceable.

Yet a further object of the present invention is to provide a plowing device capable of selective discharge orientation with a flexible moldboard having increased useful life.

An additional object of the present invention is to provide a plowing device capable of easily bypassing obstacles located on a plowed surface without causing damage to the plowing device.

The above objects as well as other objects not specifically enumerated are accomplished by a plowing assembly in accordance with the present invention. The plowing assembly of the present invention includes a cross-beam and a moldboard assembly. A first forming rib is disposed at one end portion of the cross-beam and has a first device for retaining a first upper corner portion of the moldboard assembly. A second forming rib is disposed at an opposite end portion of the cross-beam and has a second device for retaining a second upper corner portion of the moldboard assembly. The assembly also includes first and second actuating devices for pivoting the cross-beam around a pivot point such that the first and second forming ribs conform the moldboard assembly into a desired shape.

BRIEF DESCRIPTION OF THE DRAWINGS

The preferred embodiments of the present invention will be described in greater detail with reference to the accompanying drawings, wherein like members bear like reference numerals and wherein.

DETAILED DESCRIPTION

Figure 1:
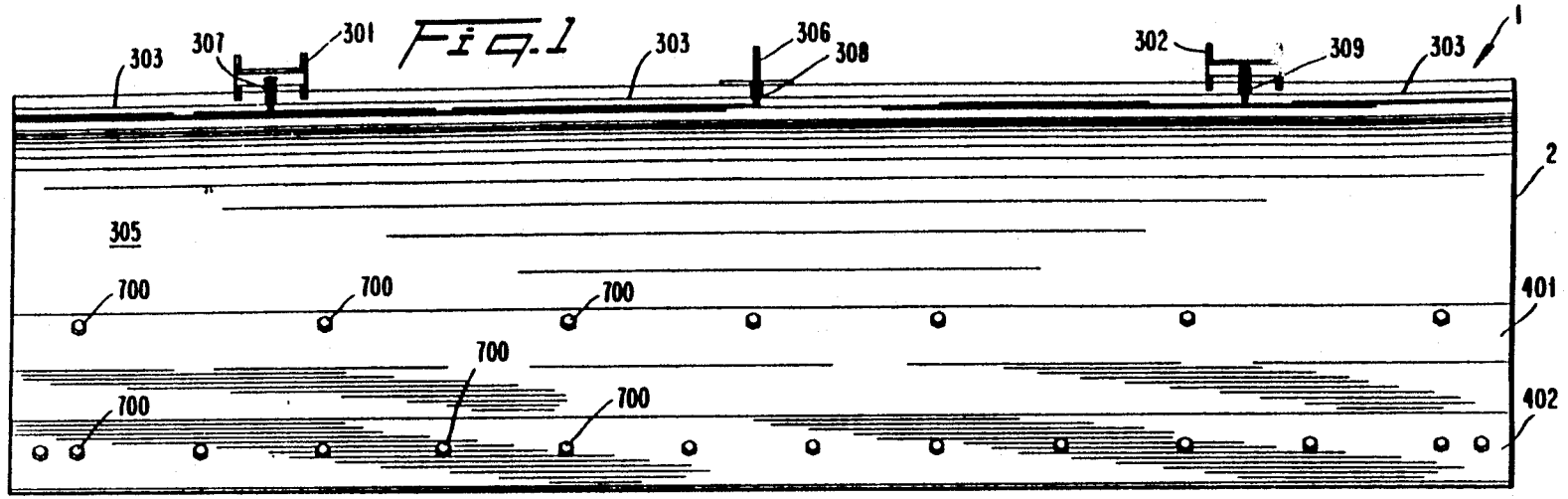
FIG. 1 is a plan view of an embodiment of the present invention.
Figure 2:
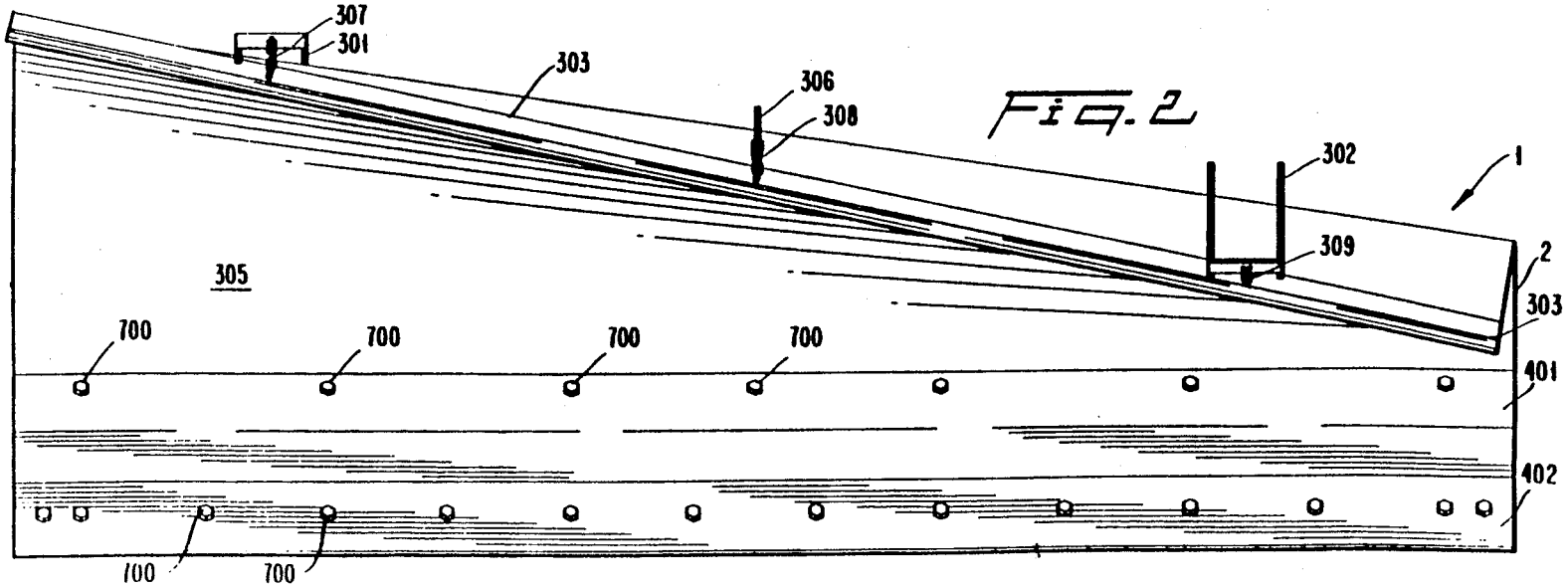
FIG. 2 is a plan view of an embodiment of the present invention oriented in a right-hand discharge position.

In FIGS. 1–19, a snowplow 1 in accordance with an embodiment of the present invention is shown. As shown in FIG. 1, the snowplow 1 includes a moldboard assembly 2 having a retention strip 303, a flexible moldboard 305, a transition strip 401, and a cutting edge 402. As indicated in a side view of the snowplow 1 in FIG. 12, an edge of the flexible moldboard 305 includes a nylon ball arrangement that serves to flexibly retain the flexible moldboard 305 in a compartment of the retention strip 303. At an opposite edge, the flexible moldboard 305 is sandwiched between the transition strip 401 and a reinforcement panel 411 by a fastener 700.

Figure 12:
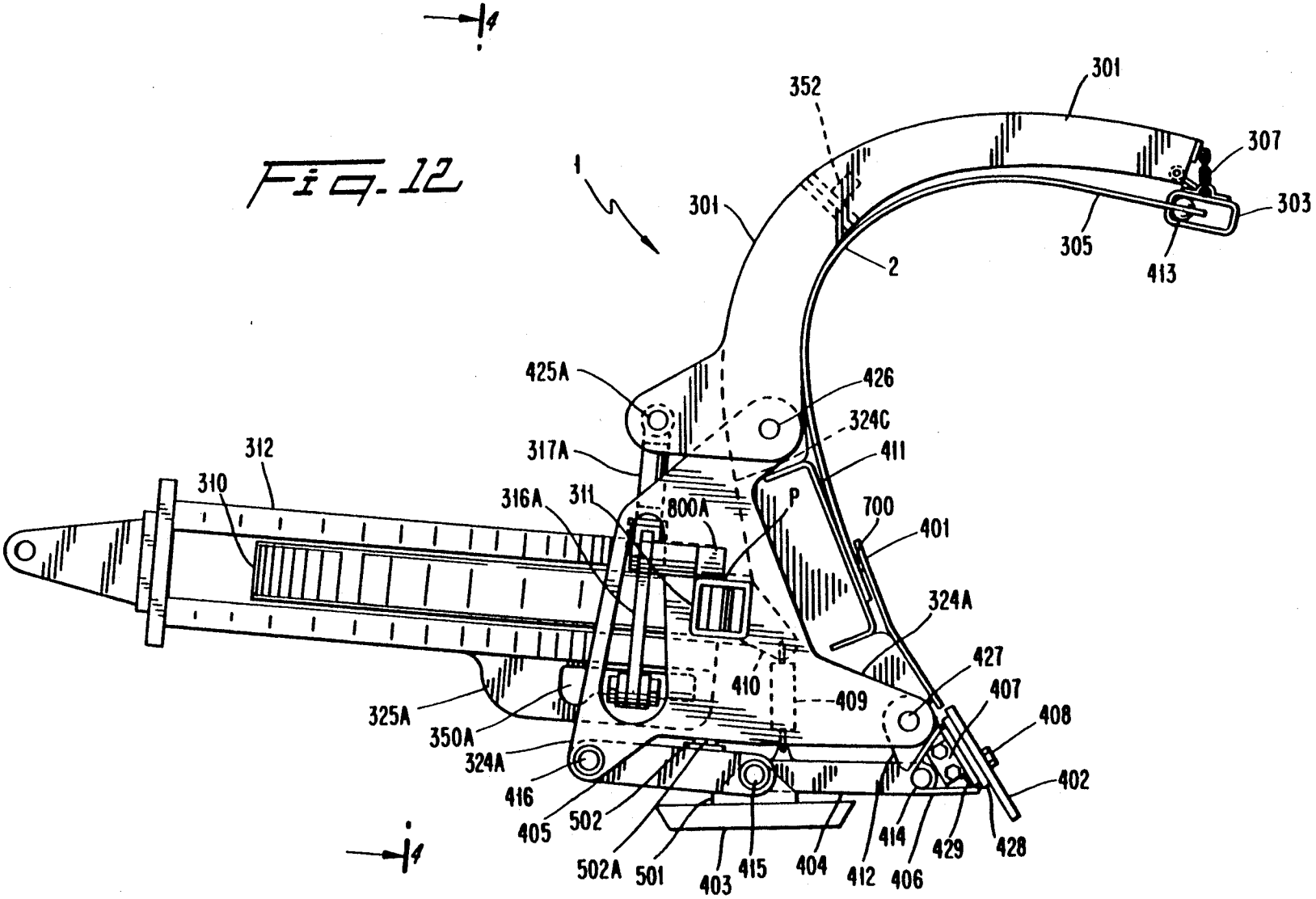
FIG. 12 is a side view of the invention of FIG. 1.

The nylon ball arrangement includes a nylon ball 413 that is positioned in each of a plurality of receiving openings (not shown) that are equally spaced from each other along the edge of the flexible moldboard. Each receiving opening is only slightly larger than the diameter of the nylon ball. The retention strip 303 is then positioned to encapsulate each nylon ball 413 along the edge of the flexible moldboard as shown in FIG. 12. A cap (not shown) is then secured to each end of the retention strip 303 in order to prevent contaminants from entering the interior of the retention strip 303 and to prevent relative movement of the retention strip 303 in a direction parallel to the edge of the flexible moldboard. The interior of the retention strip 303 has a rectangular shape such that the edge of the moldboard as retained in the retention strip 303 by the nylon balls 413 is free to move along the length of the rectangular shape of the strip 303 according to any forces applied on the flexible moldboard during snowplow operation.

As best seen in FIGS. 12 and 17–19, the cutting edge 402 is attached to a mounting plate 428 by fasteners 408. The cutting edge 402 and mounting plate 428 are then fixed to a support strip 429 of a cutting edge support receptacle 406 by a wedge 407.

Figure 18:
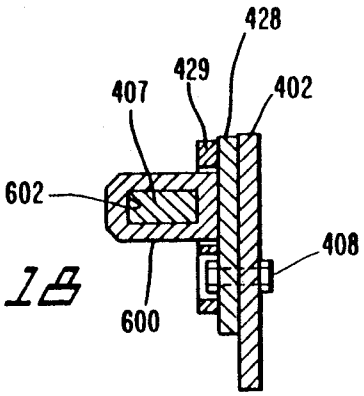
FIG. 18 is a cross-sectional view of the attachment mechanism of FIG. 17.
Figure 17:
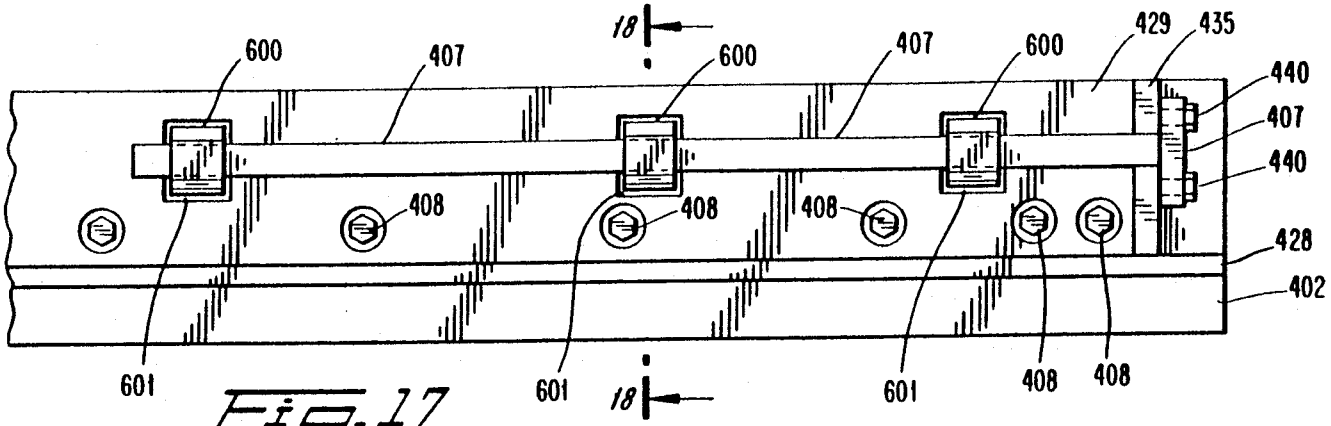
FIG. 17 is view of the attachment mechanism of a cutting edge of the invention of FIG. 1.
Figure 19:
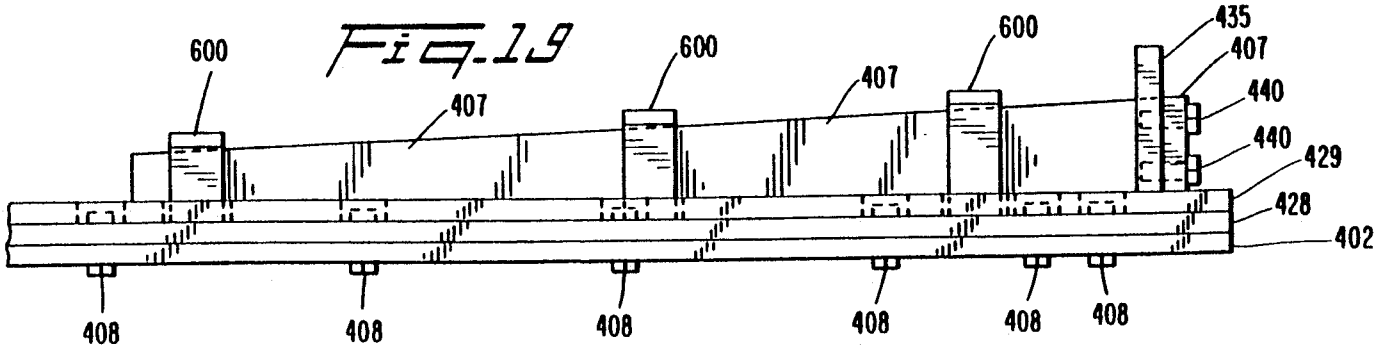
FIG. 19 is a side view of the attachment mechanism of FIG. 17.

Referring to FIGS. 17–19, a plurality of wedge receptacles 600 are positioned at intervals along one end portion of the mounting plate 428, each wedge receptacle 600 having a slot 602 for receiving the wedge 407. When the mounting plate 428 is attached to the support strip 429, the wedge receptacles 600 are received in corresponding openings 601 of the support strip 429 such that each receptacle 600 and thus each slot 602 protrudes outwardly from the support strip 429. The wedge 407 is inserted progressively through each slot 602 of each receptacle 600 along a portion of the mounting plate 429 thus securing the mounting plate 428 along with the cutting edge 402 to the support strip 429.

Since the wedge has a tapered shape as shown in FIG. 19, the size of each slot 602 progressively decreases with each receptacle 600 on the mounting plate in accordance with the wedge taper. Such a progressive decrease in size of each slot 602 ensure that substantially constant retention force is maintained between the wedge 407 and the support strip 429 along the length of the wedge 407. In order to keep the wedge in proper engagement with the slots 602, the wedge is secured by fasteners 440 to a support strip flange 435 located near the end of the mounting plate 428.

FIGS. 17 and 18 are representative of the mounting arrangement of the cutting edge 402 with regard to one side of the mounting plate 428. A similar wedge arrangement is incorporated on the other side of the mounting plate 428 to ensure adequate support of the cutting edge 402 on the moldboard assembly 2.

Such a wedge arrangement facilitates quick replacement of the cutting edge 402 since the fasteners 408 need not be removed to mount a new cutting edge 402 to the moldboard assembly 2. Since such fasteners 408 typically corrode during extended use, removal often proves difficult thus causing delays in replacing the cutting edge 402.

Two forming ribs 301, 302 and a pivoting rib 306 are attached to the retention strip 303 and serve to effect the shape of the flexible moldboard 305. The two forming ribs have a predetermined curved configuration to shape the flexible moldboard. The two forming ribs 301, 302 are attached to the retention strip 303 by high strength chains 307, 309, respectively, while the pivoting rib 306 is attached to the retention strip 303 by a clevis 308. The forming ribs 301, 302 are arranged on either side of the pivoting rib 306 near an end portion of the retention strip 303. According to movement of the two forming ribs 301, 302 and the pivoting rib 306, the flexible moldboard 305 may be arranged in varying configurations so as to place the plow assembly 2 into various discharge orientations such as the right-hand discharge orientation shown in FIG. 2.

Figure 3:
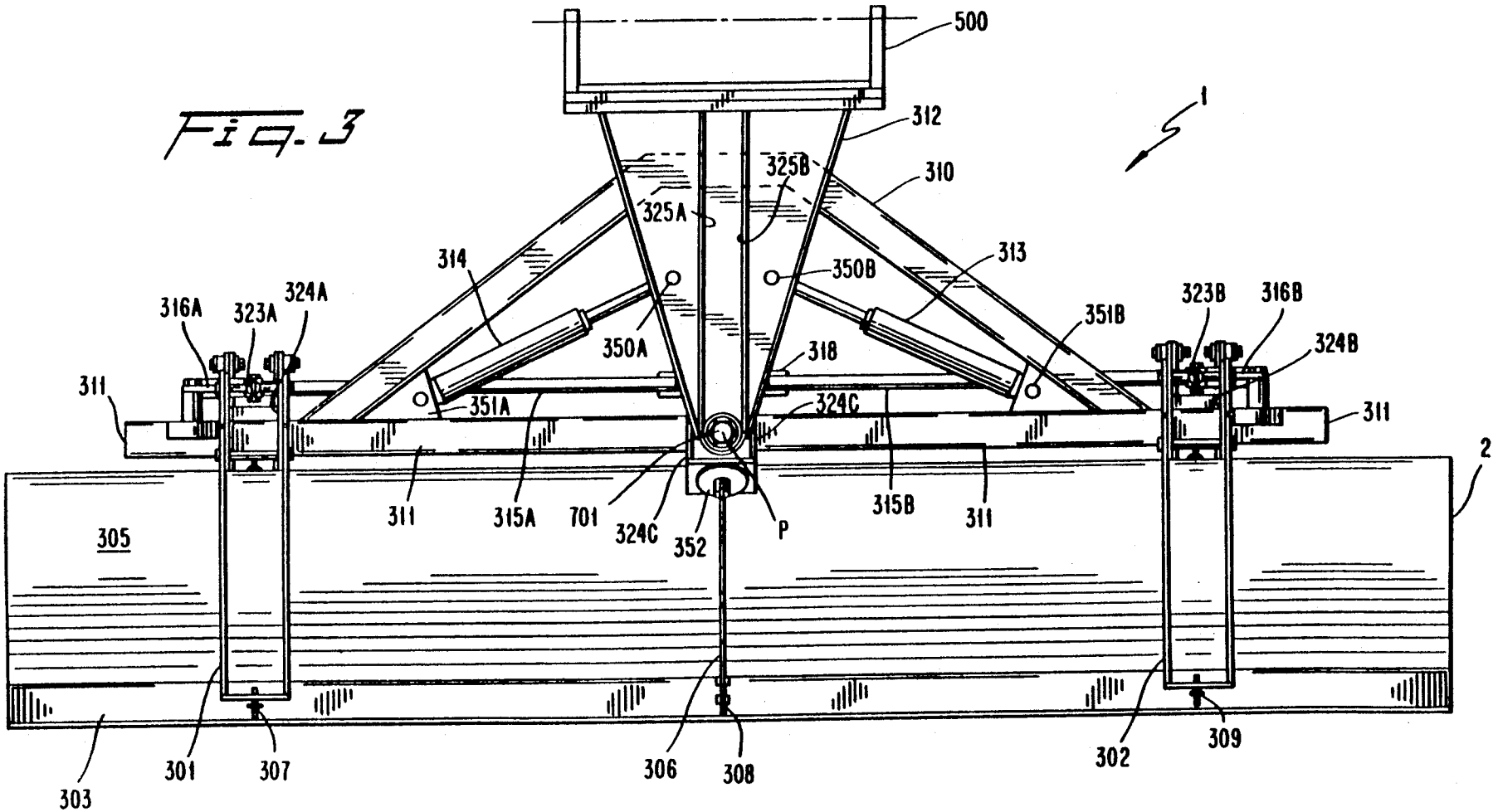
FIG. 3 is a top view of the present invention of FIG. 1.

A top view of the snowplow 1 is depicted in FIG. 3 to include a truss frame upon which the two forming ribs 301, 302, the pivoting rib 306 and the plow assembly 2 are supported. The truss frame includes a cross beam 311 fixed to a framework 310. The truss frame is pivotally attached to an A-frame 312 at a pivot point P by a pivot bolt 701 and the A-frame 312 is attached to a vehicle attachment fixture 500.

First and second actuators 313, 314 are mounted in opposing locations between the A-frame 312 and the truss frame such that actuation of either actuator will cause the truss frame to pivot about point P. In particular, one end of the first actuator 313 is attached to the A-frame 312 at a point 350B while the other end is attached to the truss frame at a corner 351B formed by the intersection of the framework 310 and the cross-beam 311. In a manner that mirrors the attachment of the first actuator 313, one end of the second actuator 314 is attached to the A-frame 312 at a point 350A while the other end is attached to the truss frame at a corner 351A which is also formed by the intersection of the framework 310 and the cross-beam 311. The hydraulic support system (not shown) for the first and second actuators 313, 314 is configured such that hydraulic pressure is provided to appropriate chambers of both actuators in order to facilitate proper movement of the truss frame. For example, in moving the truss frame to a right hand discharge position, hydraulic pressure is provided both to a rear portion of the first actuator 313 and to a front portion of the second actuator 314. The resulting actuation of each cylinder ensures proper movement of the truss frame. The same pressure arrangement is provided in corresponding chambers of the first and second actuators to move the truss into a left hand discharge position.

Figure 6:
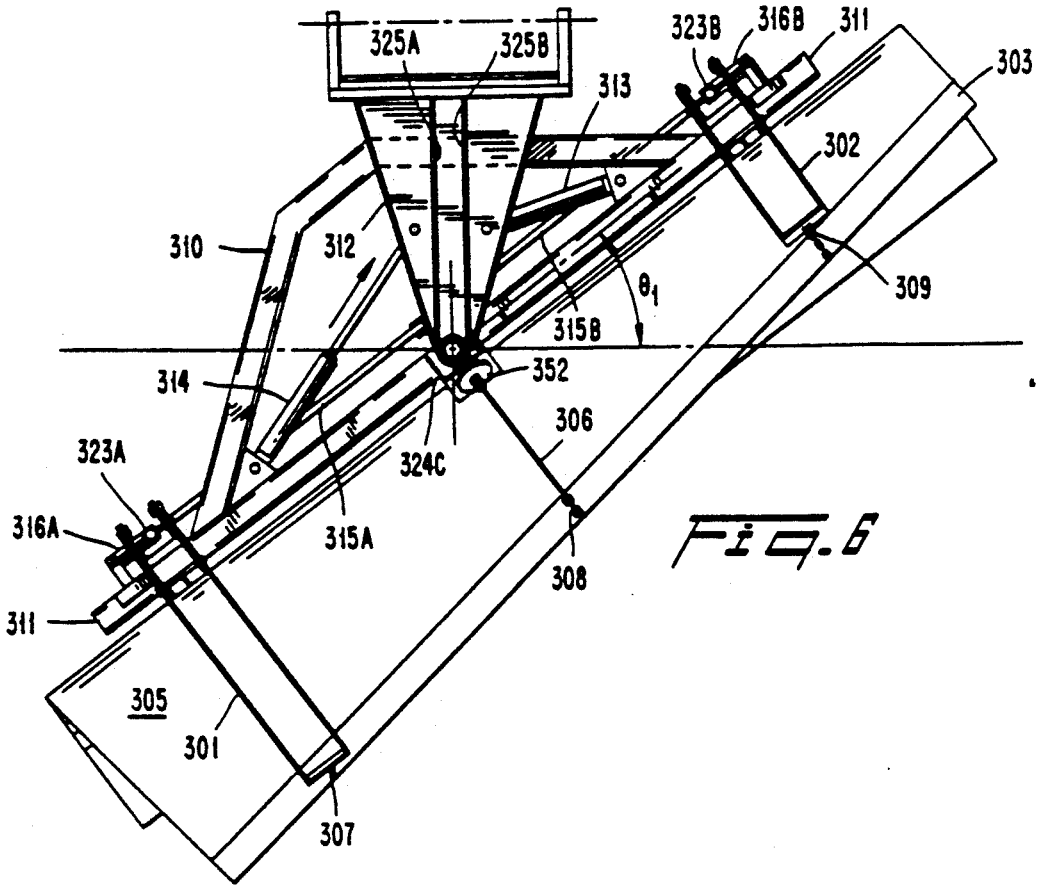
FIG. 6 is a top view of the invention of FIG. 3 in a first position.
Figure 7:
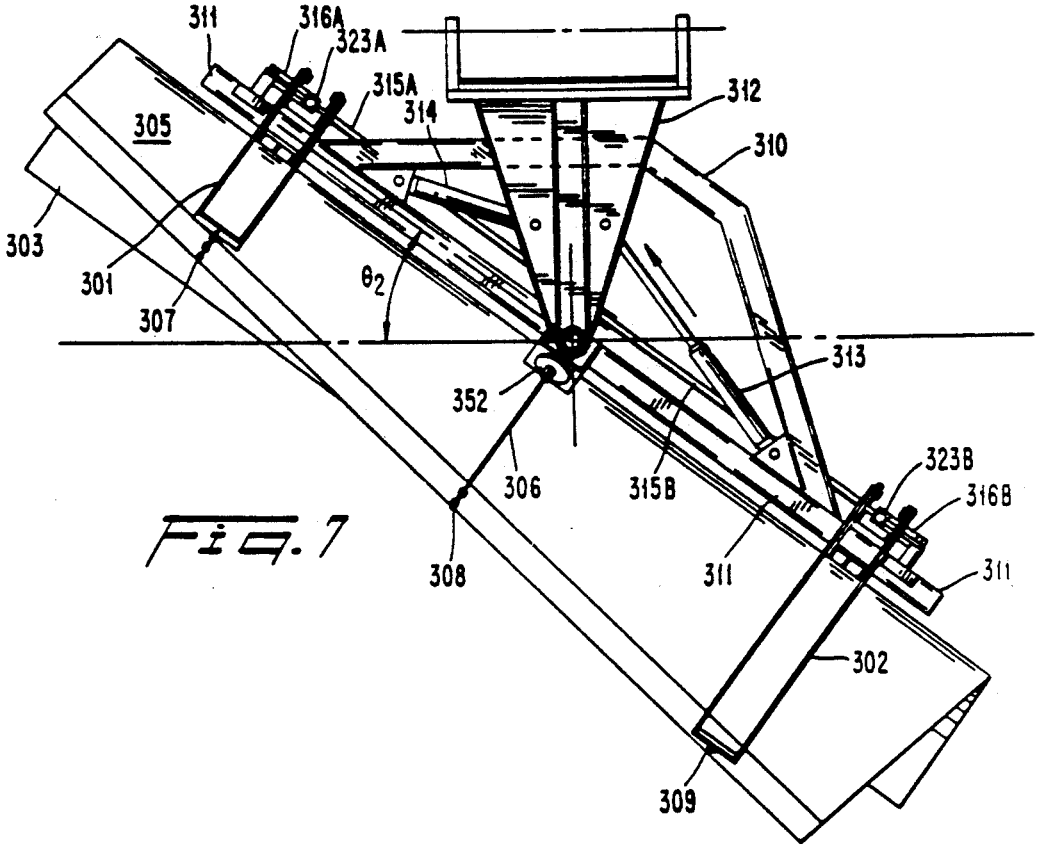
FIG. 7 is a top view of the invention of FIG. 3 in a second position.

Actuation of the first actuator 314 by the actuation system (not shown) will cause the truss frame to pivot $\widetilde{O}_1$ degrees in a counterclockwise direction as shown in FIG. 6. Actuation of the second actuator 313 by the actuation system (not shown) will cause the truss frame to pivot $\widetilde{O}_2$ degrees in a clockwise direction as shown in FIG. 7. In one embodiment, $\widetilde{O}_1$ and $\widetilde{O}_2$ will have a maximum angle of about 37°. As herein described, pivoting of the truss assembly also automatically effects the arrangement of the flexible moldboard 305 to properly configure the moldboard 305 in accordance with the orientation of the truss assembly.

Figure 4:
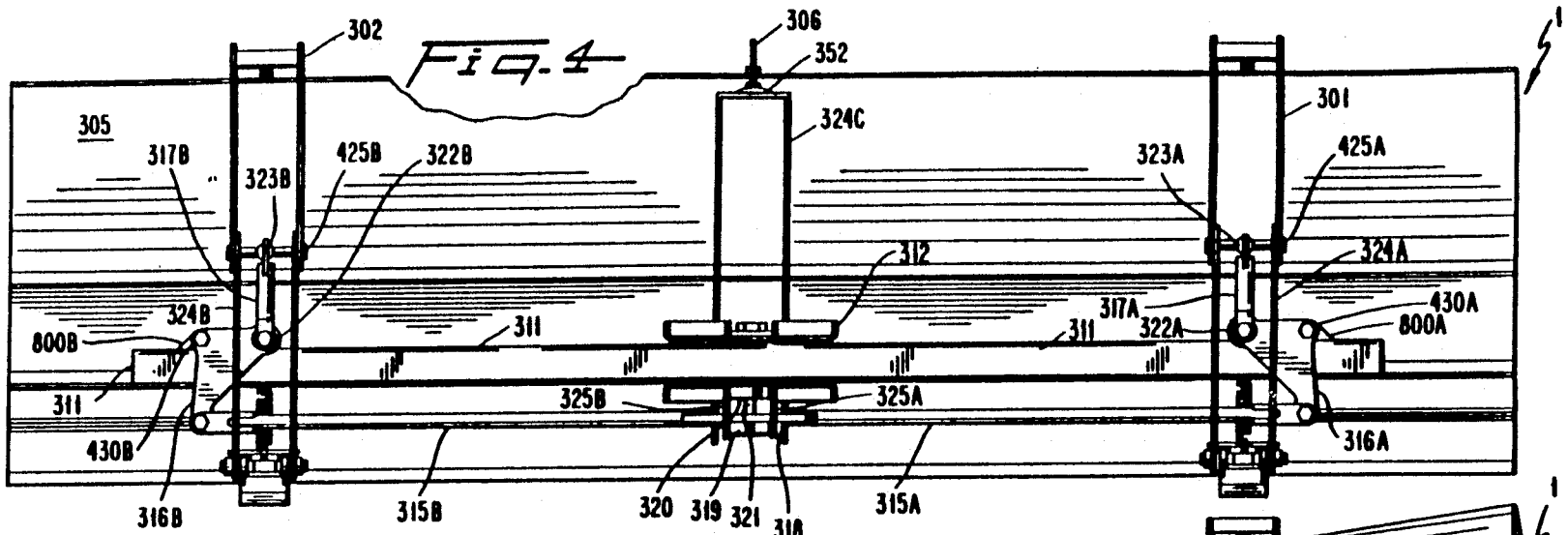
FIG. 4 is a partial cross-sectional rear view of the present invention of FIG. 1.
Figure 5:
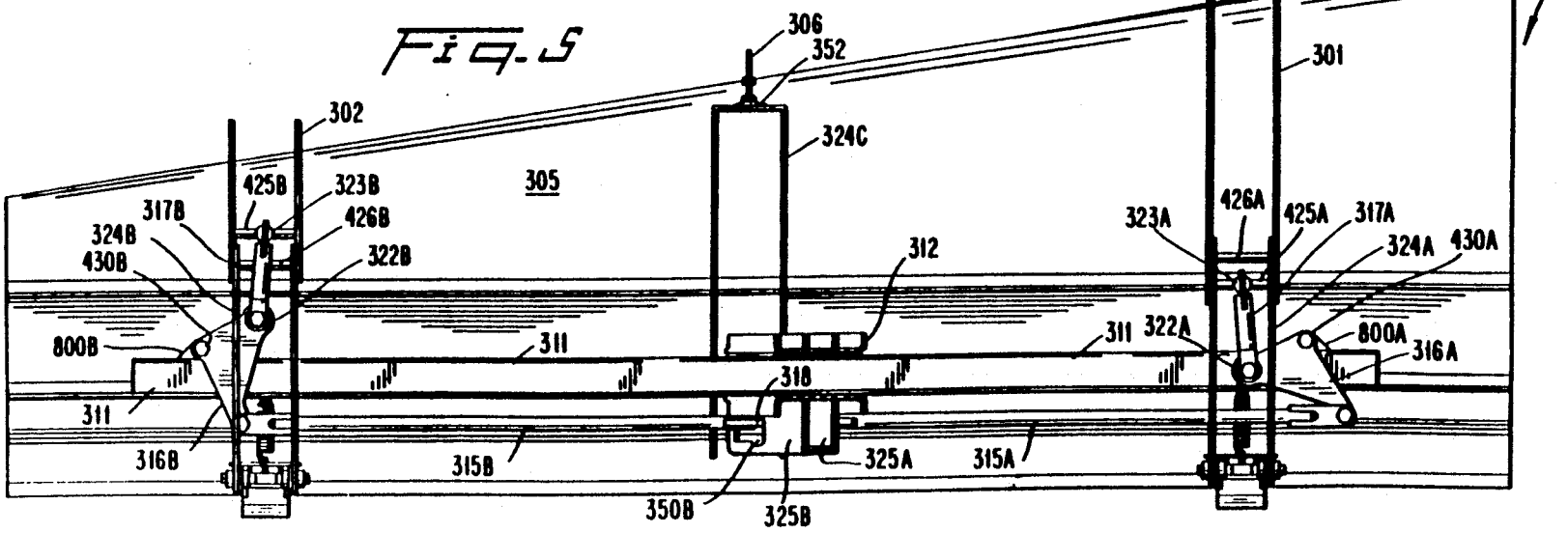
FIG. 5 is a partial cross-sectional view of the invention of FIG. 1.

Referring to FIGS. 4 and 5, the cross beam 311 supports two stationary brackets 324B, 324A at opposite ends of the cross beam 311 which, in turn, pivotally support the two forming ribs 302, 301, respectively, about a horizontal pivot axis. The stationary brackets are mounted directly to the cross beam 311 as indicated in FIG. 12 while the two forming ribs 302, 301 are pivotally mounted on the stationary brackets 324B, 324A at horizontal cross pin 426B, 426A, respectively. Pivoting of the forming ribs 302, 301 around the cross pins 426B, 426A respectively, serve to move the free ends of the forming ribs to effect the orientation of the flexible moldboard 305.

A third stationary bracket 324C is also mounted on cross-beam 311 between the two stationary brackets 324B and 324A and serves to support the pivoting rib 306. Pivoting rib 306 is mounted on the stationary bracket 324C at a pivot pin 352 around which the pivoting rib 306 is free to pivot according to any forces exerted by the moldboard assembly on the rib 306 during moldboard orientation.

The cross-beam 311 also supports two operating levers 316B, 316A (FIGS. 4 and 5) that are pivotally attached at opposite ends of cross-beam 311. The two operating levers 316B, 316A are each pivotable around pivot bolts 430B, 430A that are inserted into lugs 800B, 800A of the cross-beam 11, respectively. Each of the two operating levers 316B, 316A have the general shape of a right triangle wherein the right corner serves as the location of attachment to the cross-beam 311 while the remaining opposite corners serve as attachment locations of two linkage tubes 315B, 315A and two rib link arms 317B, 317A, respectively. Each of the rib link arms 317B, 317A is attached to its corresponding operating lever 316B, 316A by a ball joint 322B, 322A, respectively, which allows each rib link arm to pivot in any direction. The rib link arm 317B is also connected to the forming rib 302 through a ball joint 323B that is mounted on a cross-pin 425B of the forming rib 302. The rib link arm 317A is also connected to the forming rib 301 through a ball joint 323A mounted on a cross-pin 425A of the forming rib 301. In order to ensure that a desired contour of the flexible moldboard is achieved, the rib link arms 317A, 317B each may be comprised of a turnbuckle arrangement (not shown). Such a turnbuckle arrangement would allow the adjustment of the distance between the corner of each operating lever 316B, 316A and each forming rib 302, 301 which, in turn, effects the obtained contour of the flexible moldboard as achieved according to movement of the forming ribs described below.

The two linkage tubes 315B, 315A are connected to each other by a linkage joining plate 318 and, in FIG. 5, the two linkage tubes 315B, 315A are shown as having been urged to the right due to pivoting of the truss frame in a clockwise direction by the actuators 313, 314. Rightward movement of the two linkage tubes 315B, 315A causes counterclockwise pivoting of each of the operating levers 316B, 316A around pivot bolts 430B, 430A, respectively, such that rib link arm 317B is urged upward and rib link arm 317A is urged downward.

Upward movement of the rib link arm 317B causes the forming rib 302 to pivot around crosspin 426B of the stationary bracket 324B such that the end of the forming rib 302 that is attached to the retention strip 303 by the chain 309 is urged downwardly. Downward movement of the rib link arm 317A causes the forming rib 301 to pivot around the crosspin 426A of the stationary bracket 324A such that the end of the forming rib 301 that is attached to the retention strip 303 by the chain 307 is urged upwardly. The movement of the forming ribs 301, 302 causes the flexible moldboard to assume a funneled configuration and thus orient the plow assembly in the right hand discharge orientation shown in FIGS. 2 and 5. Urging of the two linkage tubes 315B, 315A in a leftward direction due to the actuation of the actuators 313, 314 will result in opposite movement of the above members and cause the plow assembly 2 to achieve a left hand discharge orientation.

In order to maintain alignment of the linkage tubes 315B, 315A with each other during pivoting of the truss frame, a pin and block assembly is incorporated into the A-frame 312 to guide movement of the linkage tubes 315B, 315A. As shown in FIGS. 8–11, the A-frame 312 is shown to include two retaining walls 325B, 325A that serve to retain two sliding blocks 319, 320 that are linked to each other by a centering pin 321. Mounted on the centering pin 321 and disposed between the two sliding blocks 319, 320 is the linkage joining plate 318 of the two linkage tubes 315B, 315A. The linkage joining plate 318 extends outwardly from the center pin 321 through openings 350B, 350A of the retaining walls 325B, 325A, respectively. The blocks 319, 320 are movable along the retaining walls 325B, 325A.

Figure 8:
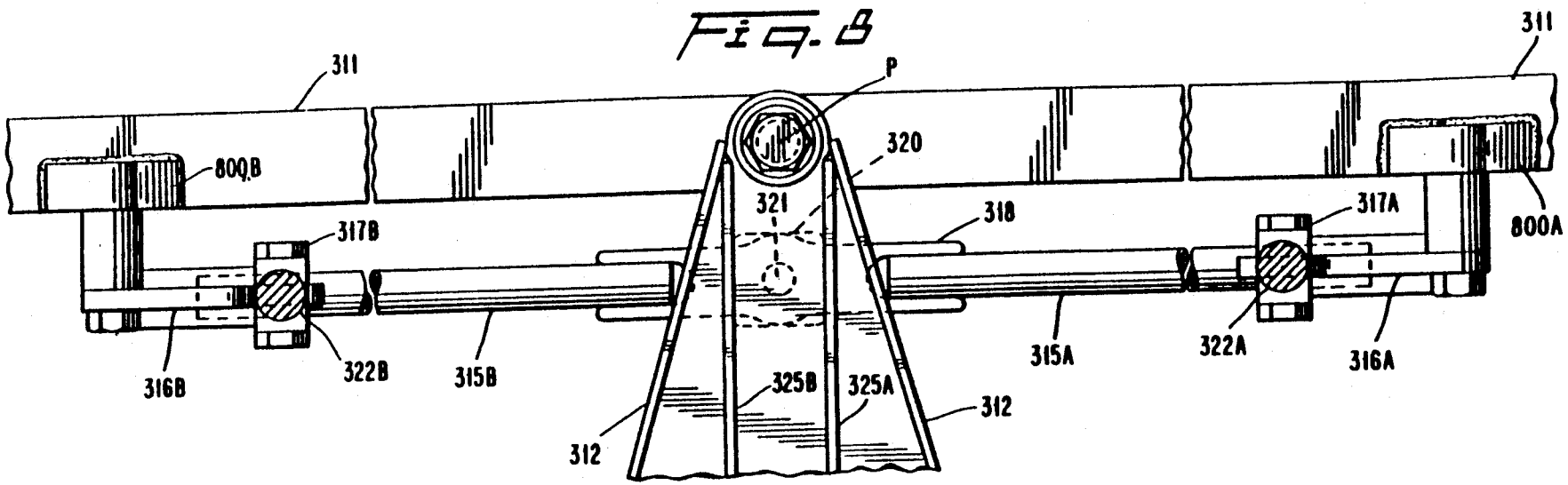
FIG. 8 is a partial top view of the linkage of the invention in FIG. 4.
Figure 9:
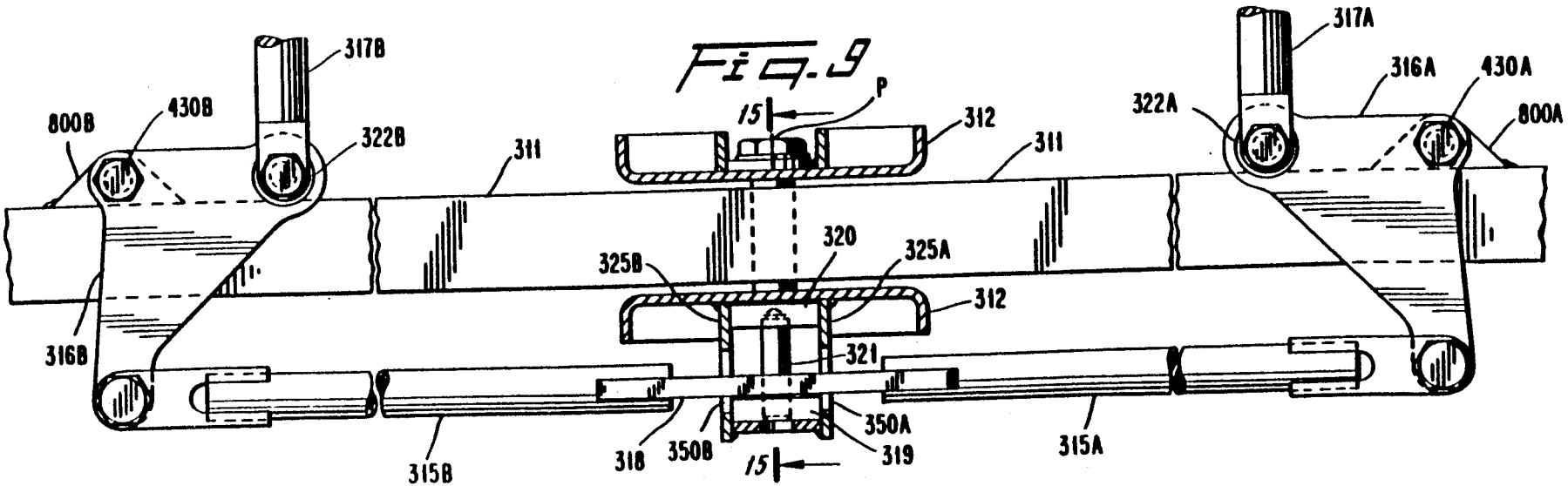
FIG. 9 is a partial side view of the linkage of the invention of FIG. 4.
Figure 10:
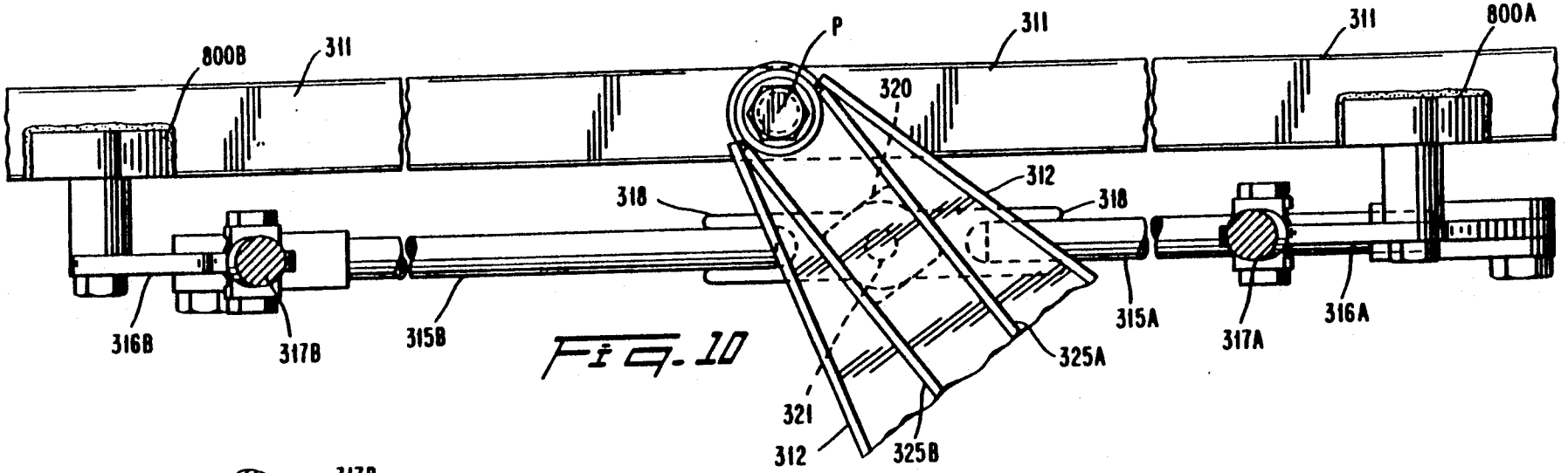
FIG. 10 is a partial top view of the linkage of the invention in FIG. 5.
Figure 11:
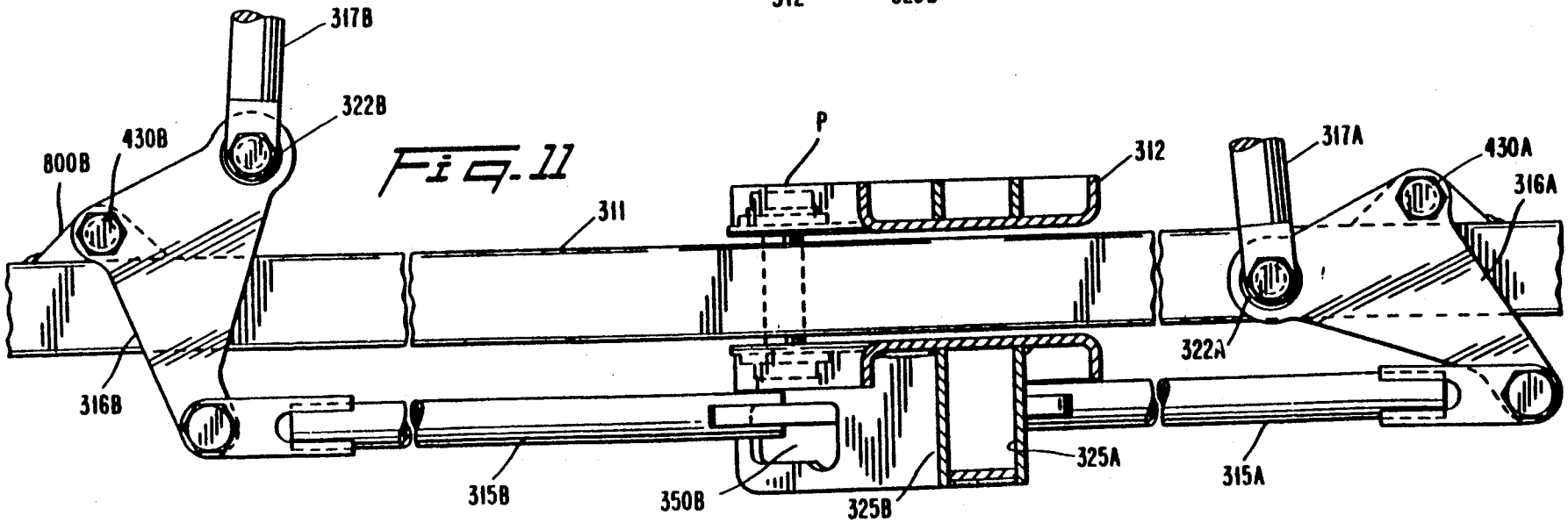
FIG. 11 is a partial side view of the linkage of the invention in FIG. 5.
Figure 15:
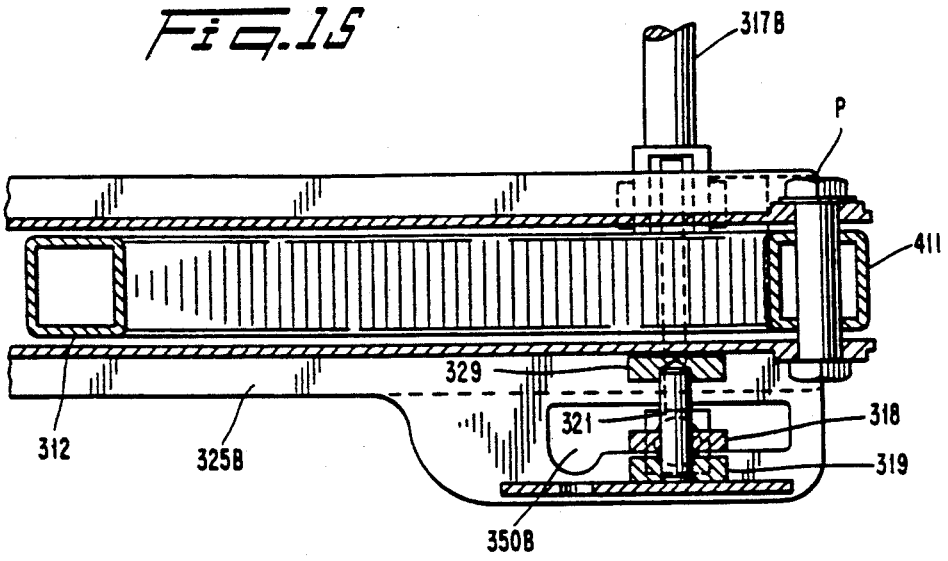
FIG. 15 is a cross-sectional view of the linkage in FIG. 9.

When the truss frame is oriented in a center position, the sliding blocks 319, 320 and the linkage tubes 315B, 315A are positioned as shown in FIGS. 8 and 9. However, when the truss frame is pivoted in a clockwise direction by the actuators 313, 314 the blocks 319, 320 and linkage tubes assume a position as shown in FIGS. 10 and 11. The linkage tubes 315B, 315A are urged to the right and the sliding blocks 319, 320 are urged along the retaining walls 325B, 325A, to allow the linkage tubes to remain in alignment with one another. Linkage joining plate 318 is allowed to rotate around pin 321 to further facilitate proper alignment of the linkage tubes. The sliding blocks 319, 320 move in a similar manner yet in an opposite direction when the truss frame is pivoted in a counterclockwise direction by the actuator 314. FIG. 15 shows a cross-sectional view of the pin and block assembly.

As shown in FIGS. 12–14 and 16, the snowplow 1 also includes a trip mechanism to avoid damage to the snowplow when obstacles located on the plowing surface are encountered. FIGS. 12–14 and 16 are representative of a trip mechanism located beneath the stationary bracket 324A at one end portion of the snowplow 1, however, a similar trip mechanism is located beneath the stationary bracket 324B at an opposite end portion of the snowplow. Locating trip mechanisms at both locations ensures proper avoidance of damage to the snowplow.

The trip mechanism includes two linkage members 404, 405 and a plowshoe 403. One end of the linkage member 404 is pivotally mounted at pivot point 414 of the cutting edge support receptacle 406. The support receptacle 406 itself is pivotable about pivot point 427. An opposite end of linkage member 404 is pivotally mounted a pivot point 415 secured to the plowshoe 403 through flange 501. One end of linkage member 405 is pivotally mounted at pivot point 416 of stationary bracket 324A. An opposite end of linkage member 405 is pivotally mounted at pivot point 415 along with linkage member 404. A trip return spring 409 is arranged in tension between a cross-beam flange 410 and the linkage member 404. A trip stop surface 502 is mounted on linkage member 405 to limit the pivot action of linkage member 405 against a mating surface 502A mounted on the stationary bracket 324A. The position of the mating surface 502A relative to the stationary bracket 324A may be varied according to adjustment screws 503. For example, if it is desired to maintain a space between the cutting edge 402 and the plowed surface when the trip mechanism is unactuated, the mating surface 502A is positioned away from the stationary bracket 324A thus reducing how far the linkage member 405 may pivot upward. The reduction in available pivoting distance of linkage member 405 will result in a space being created between the cutting edge 402 and the plowed surface.

Figure 13:
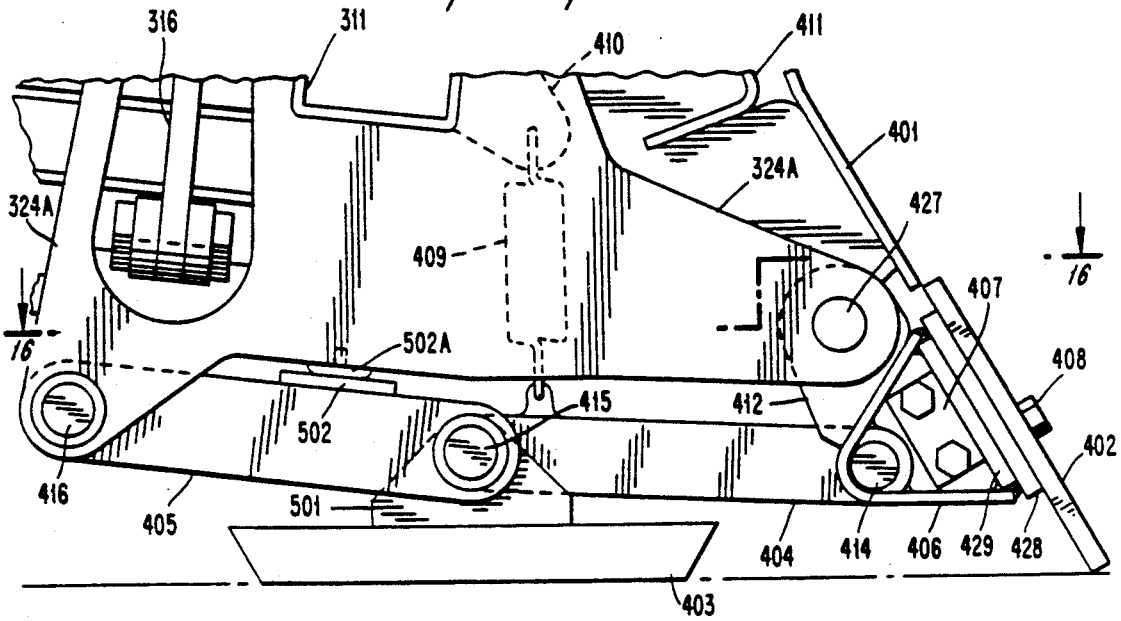
FIG. 13 is a enlarged view of a tripping mechanism of the invention in FIG. 12.
Figure 14:
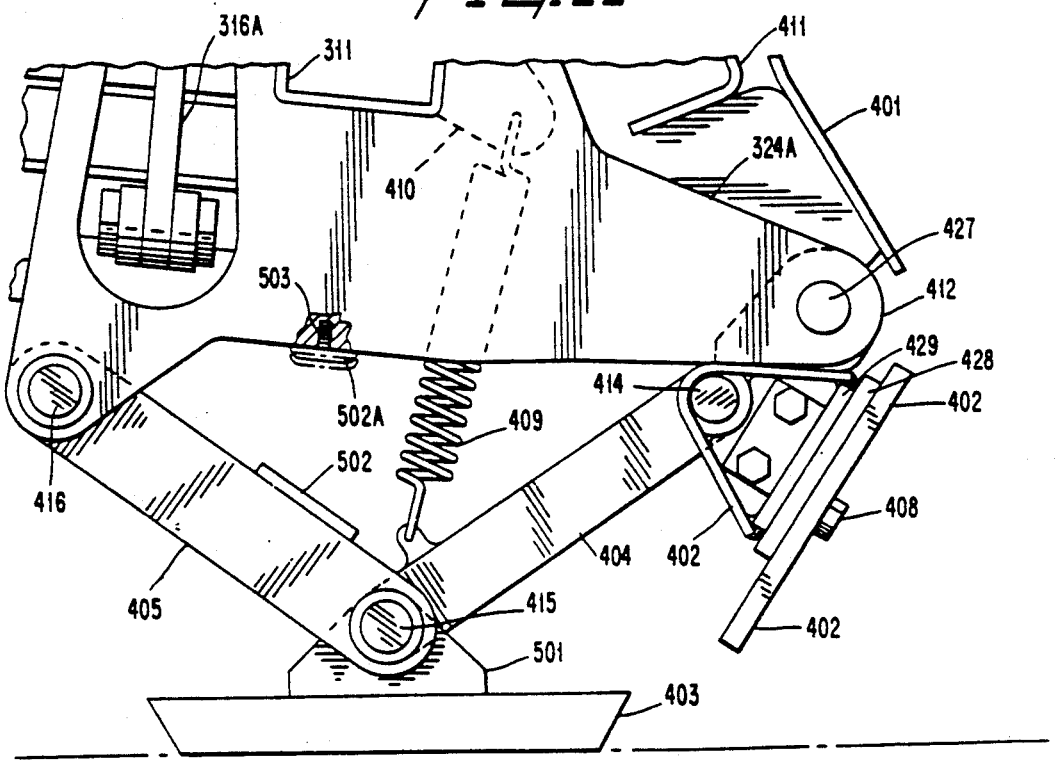
FIG. 14 is an enlarged view of the tripping mechanism of FIG. 13 in an actuated position.

FIGS. 13 and 14 show enlarged views of the trip mechanism in a normal position and in an actuated position, respectively. If no obstructions are encountered on the plowed surface by the cutting edge 402, the plowshoe 403 remains oriented at a level near the plowed surface and the cutting edge 402 is maintained in contact with the plowed surface. Should an obstruction be encountered by the cutting edge 402 during forward motion of the snowplow 1, the tripping mechanism becomes actuated as shown in FIG. 14 to allow the obstruction to pass underneath the snowplow.

As the obstruction is encountered by the cutting edge 402, the cutting edge support receptacle 406 is caused to pivot around pivot point 427 such that linkage member 404 causes movement of pivot point 415 in a downward direction. The downward movement of pivot point 415 causes the plowshoe 403 to contact the plowed surface and thus lift the snowplow 1 in an upward manner. Upward movement of the snowplow 1 provides clearance for the obstacle such that the plow may travel beyond the obstacle without damage.

Figure 16:
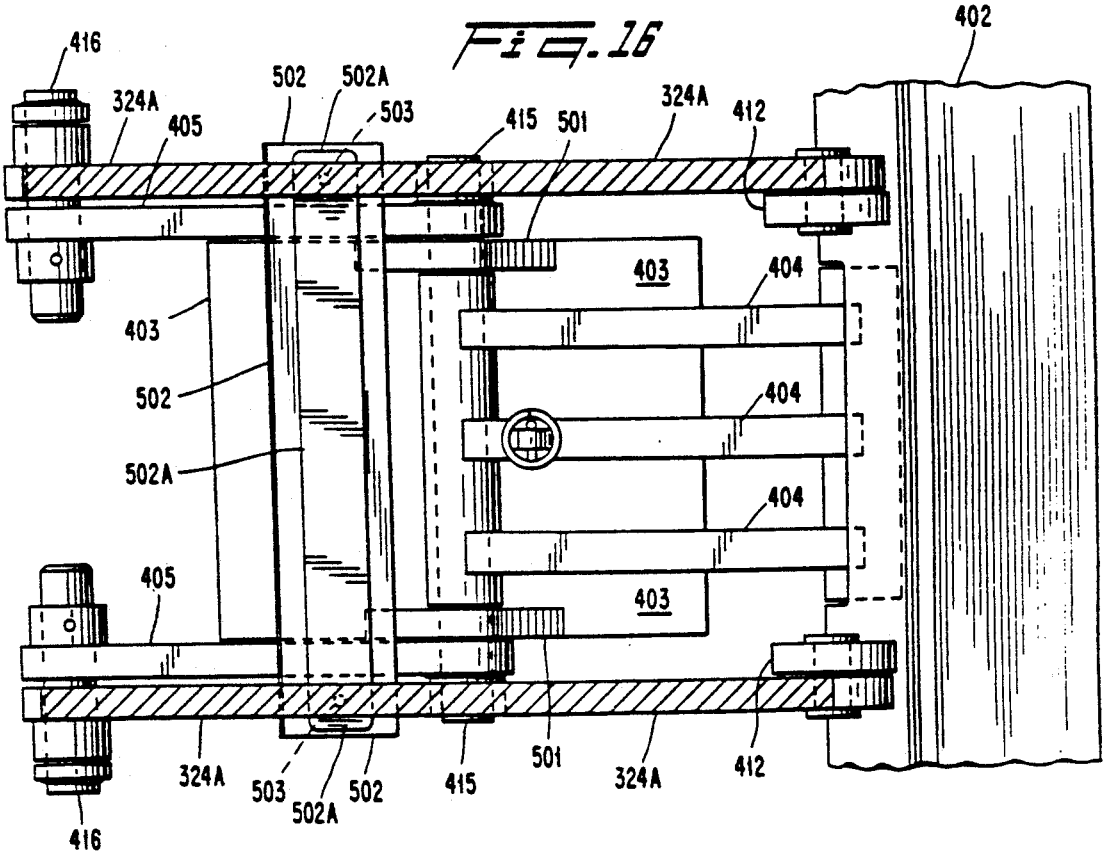
FIG. 16 is a cross-sectional top view of the tripping mechanism as shown in FIG. 13.

After the obstacle has cleared the cutting edge 302, the weight of the plow along with the force of the tension spring 409 urges the linkage member 404 to return to a normal position until stop plate 502 mounted on linkage member 405 comes in contact with stationary bracket 324A. As the linkage member 404 returns to a normal position, the cutting edge support receptacle 406 pivots around pivot point 427 thus returning the cutting edge 402 to a normal plowing position in contact with the plowed surface. A cross-sectional top view of the tripping mechanism in a normal position is shown in FIG. 16.

The principles, a preferred embodiment and mode of operation of the present invention have been described in the foregoing specification. However, the invention which is intended to be protected is not to be construed a limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A plow assembly comprising:

a cross-beam;

a moldboard assembly disposed on said cross-beam, said moldboard assembly having a cutting edge disposed at a lower edge of said moldboard assembly; and quick release retention means for attaching said cutting edge to said plow assembly, the quick release retention means including a mounting plate connected to said cutting edge, the mounting plate having a plurality of wedge receptacles, a support strip having a plurality of receptacle slots for receiving the wedge receptacles of the mounting plate, and at least one wedge, the wedge being inserted through two or more of the plurality of wedge receptacles to secure the mounting plate to the support strip.

2. A plow assembly according to claim 1, wherein said quick release retention means includes two wedges, each wedge being insertable through half of the plurality of wedge receptacles.

3. A plow assembly according to claim 1, wherein the wedge has a tapered edge and the wedge receptacles decrease in size according to the wedge shape so that a substantially constant retention force is maintained between the wedge and the support strip along the length of the wedge.

4. A plow assembly according to claim 1, further including means for holding the wedge in engagement with the wedge receptacles.

5. A plow assembly comprising:

a support frame;

a truss frame attached to said support frame at a pivot point and pivotable in one of a clockwise and counterclockwise direction around said pivot point;

a moldboard assembly disposed on said truss frame, said moldboard assembly including a cutting edge assembly pivotally mounted at a lower edge of said moldboard assembly; and means, including a linkage connected to said cutting edge, for automatically raising said plow assembly, said means for automatically raising being urged by said linkage to raise said plow assembly in response to said cutting edge assembly being pivoted by contact between an obstruction and said cutting edge, said means for automatically raising including at least one ground supported lifting member movable in a downward direction.

6. A plow assembly as set forth in claim 5, wherein said means for automatically raising said plow assembly includes spring means for biasing said first linkage member such that said lifting member is urged in an upward direction in the absence of contact between said obstacle and said cutting edge assembly.

* * * * *